US007397198B2

(12) United States Patent
Oyama

(10) Patent No.: US 7,397,198 B2
(45) Date of Patent: Jul. 8, 2008

(54) FLUORESCENT LAMP DRIVER AND LIQUID CRYSTAL DISPLAY APPARATUS

(75) Inventor: Yoshiki Oyama, Kanagawa (JP)

(73) Assignee: Sony Corporation, Tokyo (JP)

( * ) Notice: Subject to any disclaimer, the term of this patent is extended or adjusted under 35 U.S.C. 154(b) by 324 days.

(21) Appl. No.: 11/126,773

(22) Filed: May 11, 2005

(65) Prior Publication Data

US 2005/0253536 A1 Nov. 17, 2005

(30) Foreign Application Priority Data

May 13, 2004 (JP) ..... 2004-143510
Feb. 14, 2005 (JP) ..... 2005-035445

(51) Int. Cl.
*H05B 41/16* (2006.01)

(52) U.S. Cl. ..... 315/282; 315/274; 315/291; 315/307; 315/312

(58) Field of Classification Search ..... 315/274–282, 315/283–287, 291, 307, 312, 323–325
See application file for complete search history.

(56) References Cited

U.S. PATENT DOCUMENTS 6,329,763 B1 * 12/2001 Pascente ..... 315/277
7,187,139 B2 * 3/2007 Jin ..... 315/274
2005/0062436 A1 * 3/2005 Jin ..... 315/244
2005/0269973 A1 * 12/2005 Jang et al. ..... 315/307
2006/0038508 A1 * 2/2006 Lin et al. ..... 315/276
2006/0091821 A1 * 5/2006 Li et al. ..... 315/209 R
2006/0214604 A1 * 9/2006 Matsuura ..... 315/291

FOREIGN PATENT DOCUMENTS

| | | |
|---|---|---|
| JP | 6 19299 | 3/1994 |
| JP | 10-92589 | 4/1998 |
| JP | 10 134971 | 5/1998 |
| JP | 11-8087 | 1/1999 |
| JP | 2002-203689 | 7/2002 |
| JP | 2002 233158 | 8/2002 |
| JP | 2002 270387 | 9/2002 |

* cited by examiner

*Primary Examiner*—Tuyet Vo
(74) *Attorney, Agent, or Firm*—Frommer Lawrence & Haug LLP; William S. Frommer; Ellen Marcie Emas

(57) ABSTRACT

In order to suppress leak current at the time of high voltage application to a fluorescent lamp so as to improve the luminous efficiency, the present invention provides a fluorescent lamp driver, which includes switching means that switches a DC power supply voltage, and a first transformer and a second transformer configured to obtain AC voltages each having reverse polarity, as AC voltages excited from primary winding to secondary winding of the respective transformers, on the basis of output voltages of the switching means, in which the first transformer and the second transformer are positioned in the vicinity of both ends of the fluorescent lamp, and the AC voltage obtained in the secondary winding of the first transformer is applied to one terminal of the fluorescent lamp and the AC voltage obtained in the secondary winding of the second transformer is applied to the other terminal of the fluorescent lamp.

6 Claims, 10 Drawing Sheets

RELATED ART

FLUORESCENT LAMP DRIVER AND LIQUID CRYSTAL DISPLAY APPARATUS

CROSS REFERENCES TO RELATED APPLICATIONS

The present document contains subject matter related to Japanese Patent Applications JP 2004-143510 and JP 2005-035445 filed in the Japanese Patent Office on May 13, 2004 and Feb. 14, 2005, the entire contents of which being incorporated herein by reference.

BACKGROUND OF THE INVENTION

1. Field of the Invention

The present invention relates to a fluorescent lamp driver for driving a fluorescent lamp to emit light and to a liquid crystal display apparatus.

2. Description of Related Art

For example, in a display apparatus that is not of a self-luminous type such as a liquid crystal display, a backlight using a cold cathode fluorescent lamp (CCFL) as a light source is provided. FIG. 7 schematically illustrates a constitution of a fluorescent lamp driver of a related art for driving the cold cathode fluorescent lamp as a backlight provided in such a liquid crystal display apparatus. In FIG. 7, a drive/control circuit 50 is provided with a switching element or the like therein so as to receive power supply from a DC power source not shown in the figure to generate an AC voltage. This AC voltage generated by this drive/control circuit 50 is supplied to primary winding N1 of a transformer TR.

The transformer TR is a step-up or step-down transformer and excites an AC voltage received from the drive/control circuit 50 to output to secondary winding N2. One end of the secondary winding N2 of the transformer TR is connected to one terminal t10*a* of a cold cathode fluorescent lamp 10, while the other end of the second winding N2 is connected to the other terminal t10*b* of the cold cathode fluorescent lamp 10, and at the same time, connecting points of them are grounded.

In the example of the related art, there has been employed a constitution in which the terminal t10*b* of the cold cathode fluorescent lamp 10 is set to an earth potential or a potential close thereto while an AC voltage is applied to the terminal t10*a*. Namely, in the fluorescent lamp driver in this case, as shown in FIG. 8, for example, by applying a voltage V having±V level taking 0 level as a reference to the terminal t10*a* of the cold cathode fluorescent lamp 10, the cold cathode fluorescent lamp 10 is driven to emit light.

As the related art, the following patent document can be cited.

[Patent Document 1] Japanese Patent Application Publication (KOKAI) No. 11-8087

SUMMARY OF THE INVENTION

In recent years, as a screen of a display apparatus has been increasingly made larger, a cold cathode fluorescent lamp used as a backlight has been increasingly made longer. Thus, as the cold cathode fluorescent lamp is increasingly made longer, a higher voltage needs to be applied for driving the cold cathode fluorescent lamp. A high driving voltage increases a leak current component flowing through a capacitive coupling component between the cold cathode fluorescent lamp and its surroundings. Since this leak current does not contribute to the light emission of the cold cathode fluorescent lamp, the increase in the leak current may lead to a decrease in luminous efficiency.

Furthermore, there occurs a phenomenon that the leak current component becomes higher at a position closer to the opposite side (that is, grounding wire side) of the voltage applied side of the cold cathode fluorescent lamp 10, while the luminance becomes lower. In other words, in a longitudinal direction of the cold cathode fluorescent lamp 10, there occurs luminance unevenness that the terminal t10*a* side is bright and the terminal t10*b* side is dark.

In light of the foregoing, according to the constitution as shown in FIG. 7, as the cold cathode fluorescent lamp is increasingly made longer due to the large screen of the display, the leak current is disadvantageously increased, thereby deteriorating the luminous efficiency and facilitating the occurrence of the luminance unevenness.

In the above-mentioned Patent Document 1, a constitution is described in which two sets of drive circuits and transformers for driving a cold cathode fluorescent lamp are prepared and arranged at both ends of the cold cathode fluorescent lamp to apply voltages each having reverse polarity from the respective ends. Thus, according to the constitution in which the voltages each having reverse polarity are applied from both ends, double the voltage level applied to each of the ends can be consequently applied to the cold cathode fluorescent lamp at this time. Namely, in this case, the voltage level to be applied from each of the sets of drive circuits/transformers can be reduced to be one-half of the case where the cold cathode fluorescent lamp is driven by only one set of drive circuit/transformer. Thus, a decrease in voltage level to be applied to the terminal of the fluorescent lamp reduces the leak current, thereby achieving high efficiency. Furthermore, in this case, since the voltages are applied from both sides, not from one side, such phenomenon of luminance unevenness as that the luminance is decreased on one side of the cold cathode fluorescent lamp and so on can be suppressed. However, according to such a constitution of Patent Document 1, it is necessary for driving one cold cathode fluorescent lamp to provide at least a plurality of sets of drive circuits, control circuits and transformers. For example, since in a display of 40-inch class, twenty cold cathode fluorescent lamps are used, if a plurality of sets of drive circuits, control circuits and transformers are provided for one cold cathode fluorescent lamp, a circuit area and manufacturing costs are considerably increased.

In the present invention, in light of the above-mentioned problems, a fluorescent lamp driver is configured to have switching means for switching a DC power supply voltage, and a first transformer and a second transformer designed to obtain AC voltages each having reverse polarity as AC voltages excited from primary winding to secondary winding of the respective transformers, on the basis of output voltages of the above-mentioned switching means. In addition, the first transformer and the second transformer are arranged to be located on both ends of the fluorescent lamp in a longitudinal direction, and then the AC voltage obtained in the secondary winding of the first transformer is applied to one terminal of the fluorescent lamp and the AC voltage obtained in the secondary winding of the second transformer is applied to the other terminal of the fluorescent lamp.

Furthermore, in the present invention, a liquid crystal display apparatus is configured to have at least a liquid crystal panel and a backlight unit using a fluorescent lamp to display an image. The liquid crystal display apparatus first has switching means for switching a DC power supply voltage as a fluorescent lamp driving unit for driving the fluorescent lamp to emit light. The liquid crystal display apparatus further comprises, as the fluorescent lamp driving unit, a first transformer and a second transformer designed to obtain AC voltages each having reverse polarity as AC voltages excited from primary winding to secondary winding of the respective transformers, on the basis of output voltages of the switching means. In addition, the fluorescent lamp driving unit is configured such that the first transformer and the second transformer are arranged to be located on both ends of the fluorescent lamp in a longitudinal direction, and then the AC voltage obtained in the secondary winding of the first transformer is applied to one terminal of the fluorescent lamp and the AC voltage obtained in the secondary winding of the second transformer is applied to the other terminal of the fluorescent lamp.

According to the above-mentioned constitution, in the first transformer and the second transformer, the AC voltages each having reverse polarity are obtained at the secondary winding on the basis of the output voltages from one switching means (drive circuit). Then, the AC voltages each having reverse polarity obtained in the secondary winding of these first transformer and second transformer are applied from both sides of the fluorescent lamp. Thus, by employing the constitution in which the AC voltages each having reverse polarity are applied from both sides of the fluorescent lamp, respectively, the voltage level to be applied to each of the terminals of the fluorescent lamp can be reduced to one-half of the voltage level of the constitution of the related art in which the output by one transformer is applied to only one terminal of the fluorescent lamp. Namely, since the voltage level to be applied to each of the terminals can be reduced in this manner, the leak current can also be reduced.

Furthermore, by employing the constitution in which the voltages are applied from both sides of the fluorescent lamp, luminance unevenness that only the voltage applied side becomes brighter, for example, as in a case where a high voltage is applied to only one side or the like can be reduced. In addition, the present invention employs the constitution of obtaining the voltages each having reverse polarity in the first transformer and the second transformer, which can make it unnecessary to provide both the transformer and the drive circuit on each side of the fluorescent lamp.

Thus, according to the present invention, the voltage level to be applied to the fluorescent lamp can be reduced to one-half of the voltage level required in the related art, thereby reducing the leak current. In addition, such a reduction in leak current can improve the luminous efficiency. Furthermore, by employing the constitution in which the voltages are applied from both sides of the fluorescent lamp using the two transformers, the luminance unevenness can be suppressed.

Furthermore, in the present invention, by employing the constitution of obtaining the voltages each having reverse polarity in the first transformer and the second transformer on the basis of the output voltages of one drive circuit, both the transformer and the drive circuit do not need to be provided on each side of the fluorescent lamp, thereby reducing a circuit area and circuit manufacturing costs as compared with the case where both the transformer and the drive circuit are provided on each side of the fluorescent lamp.

Furthermore, in the present invention, by arranging the first transformer and the second transformer to be located on both ends of the fluorescent lamp, a length of wiring for connecting the secondary winding of each of the transformers and each of the terminals of the fluorescent lamp can be made as short as possible. Such a short wiring length from the secondary winding to the terminal of the fluorescent lamp can further suppress the leak current, further improving the luminous efficiency.

Since the two transformers are provided to reduce the voltage level to be applied to each of the terminal of the fluorescent lamp, a core size of the first transformer and the second transformer in this case can be smaller than that in the case of the related art where a high voltage is applied with only one transformer.

Thereby, a core of the transformer can be thinner than that of the one in the related art, so that the fluorescent lamp driver, and further the liquid crystal display apparatus can be thinner than the related art ones.

DESCRIPTION OF THE PREFERRED EMBODIMENTS

Hereinafter, preferred embodiments for carrying out the invention (hereinafter, referred to as embodiments) are described.

Figure 1:
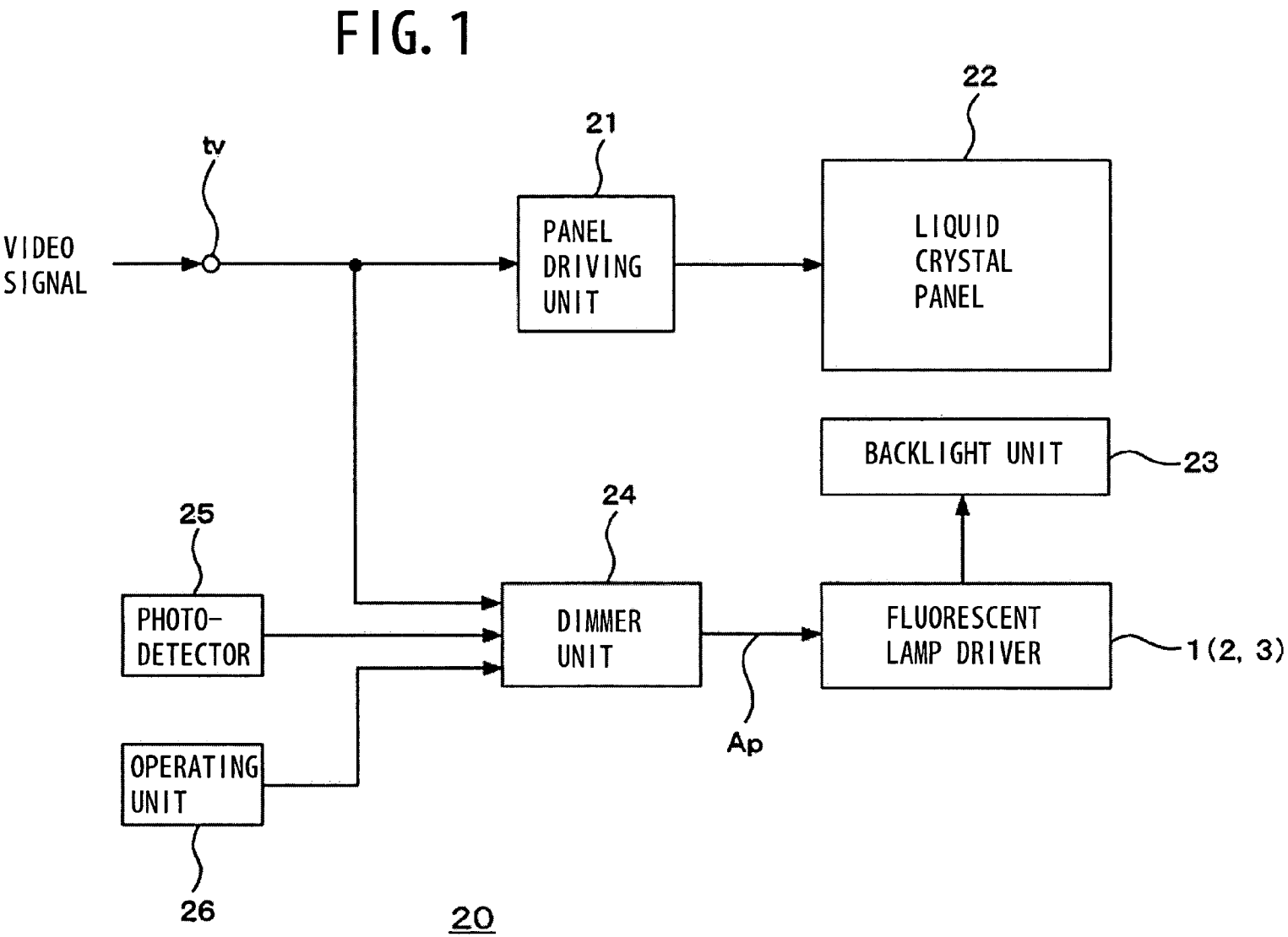
FIG. 1 is a block diagram showing a structural example of a liquid crystal display apparatus as one embodiment of the present invention.

Firstly, with reference to a block diagram of FIG. 1, a liquid crystal display apparatus 20, which comprises a fluorescent lamp driver, is described. In FIG. 1, a video signal is first inputted from a video terminal tv as illustrated. This video signal is supplied to a panel driving unit 21 and a dimmer unit 24.

The panel driving unit 21 applies necessary video signal processing to the inputted video signal to generate a driving signal for driving a liquid crystal panel 22 so as to display an image in accordance with the inputted video signal. In this manner, the liquid crystal panel 22 displays an image in accordance with the above-mentioned video signal by performing the operation in response to the driving signal generated in the panel driving unit 21.

The dimmer unit 24 generates a dimming signal Ap for adjusting the light amount of a backlight unit 23. In this case, the light amount adjustment of the backlight unit 23 is first performed on the basis of the video signal supplied as described above. Namely, the dimmer unit 24 detects, from the inputted video signal, luminance information of the image to be displayed, and sets the dimming signal Ap so as to give the light amount in accordance with this luminance information.

Furthermore, secondly, the above-mentioned setting is also made on the basis of light amount information detected in a photodetector 25 as illustrated. This photodetector 25 is constituted so as to detect the light amount, for example, in a part exposed outside a case of the display apparatus 20, thereby detecting a light amount in circumstances where the display apparatus 20 is placed. The dimmer unit 24 is designed to set the dimming signal Ap in accordance with the light amount information from the photodetector 25.

Furthermore, thirdly, the adjustment is made to follow with manual operation of a user. This manual adjustment can be performed, for example, by selecting an item such as "brightness adjustment" from a menu screen for various settings. Such manual adjustment can be made via an operating unit 26 as illustrated. The dimmer unit 24 is also designed to set the dimming signal Ap in accordance with operational information from this operating unit 26.

The dimming signal Ap set in the dimmer unit 24 in accordance with these video signal, light amount information from the photodetector 25 and operation input is supplied to a fluorescent lamp driver 1, 2 or 3. As the operating unit 26, a user interface using a remote controller can also be employed.

Each of fluorescent lamp driver circuits 1, 2 and 3 shows the fluorescent lamp driver according to each of the embodiments of the present invention. The fluorescent lamp driver 1 (2, 3) of the respective embodiments will be described in detail later.

The backlight unit 23 comprises a cold cathode fluorescent lamp as a light source in this case and is driven to emit light in accordance with the application of a driving voltage generated by the fluorescent lamp driver 1 (2, 3), as described later. At this time, the adjustment of the light amount of the backlight unit 23 is made by adjusting the generation level of the above-mentioned driving voltage in the fluorescent lamp driver 1 (2, 3) in accordance with the dimming signal Ap generated by the dimmer unit 24 as described above.

Subsequently, with reference to FIGS. 2 to 4, the fluorescent lamp driver 1 as a first embodiment in the present invention is described.

Figure 2A:
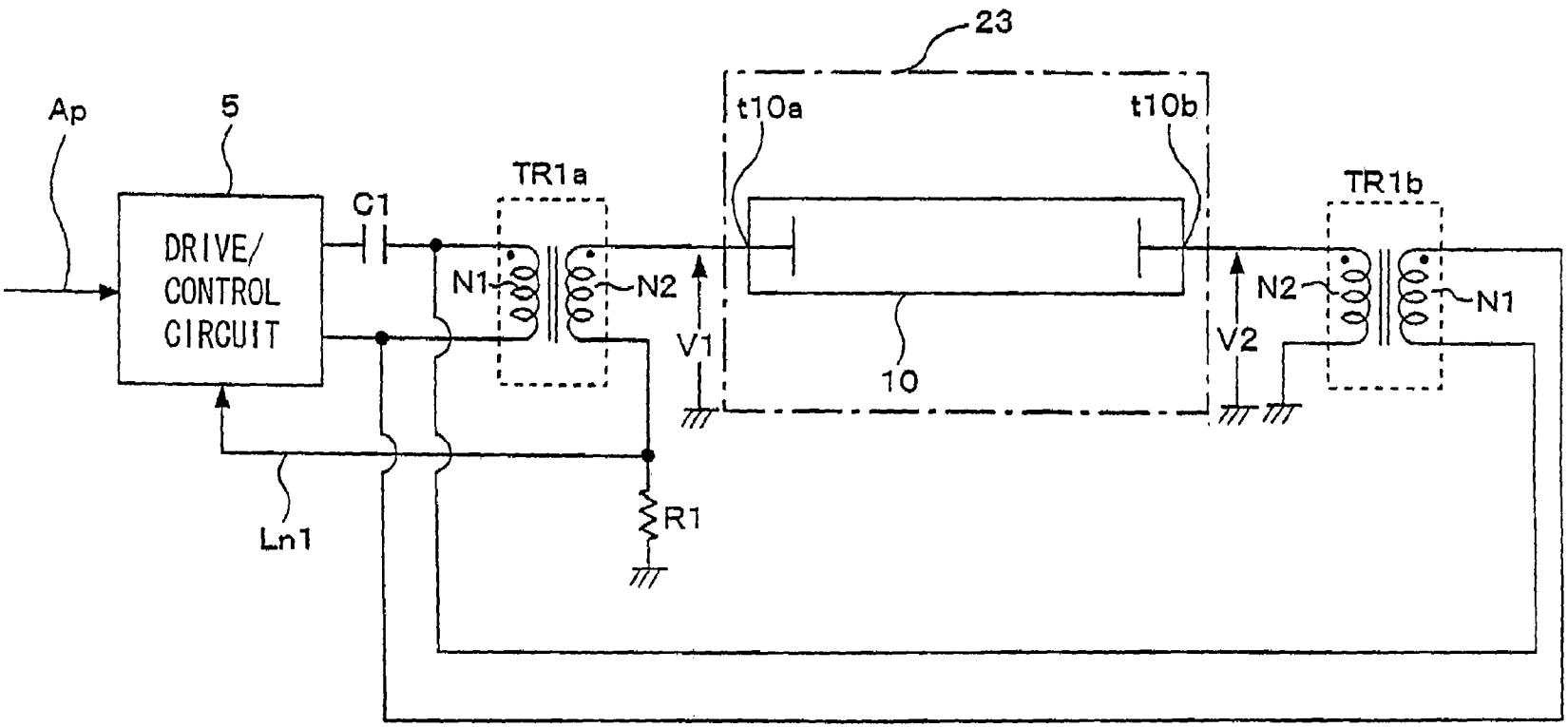
FIGS. 2A and 2B are views showing a structural example of a fluorescent lamp driver in a first embodiment of the present invention.
Figure 2B:
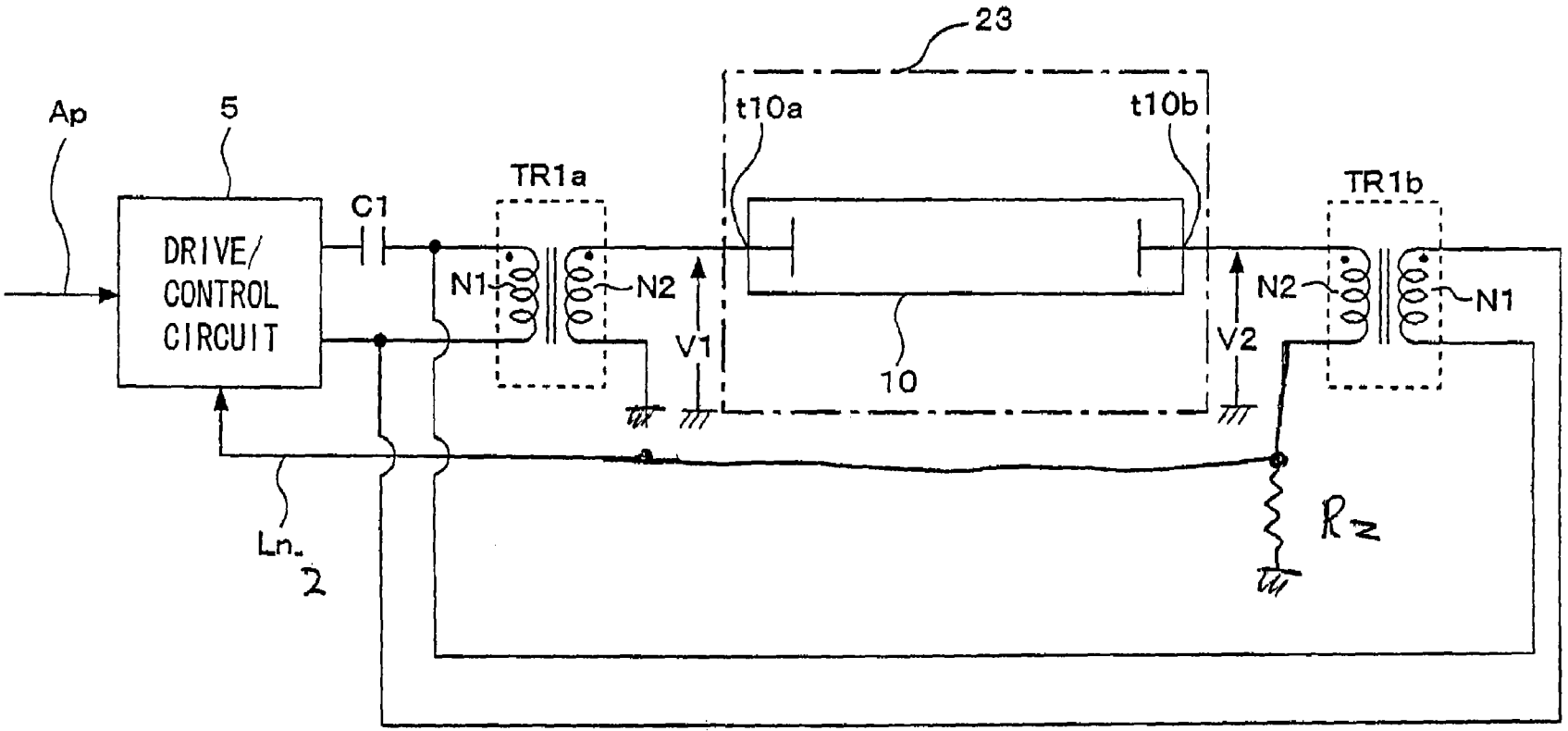

FIGS. 2A and 2B are diagrams showing a structural example of the fluorescent lamp driver 1 as the first embodiment. This diagram also shows the backlight unit 23 as shown in FIG. 1. Here, for convenience in description, an example in which the backlight unit 23 comprises only one cold cathode fluorescent lamp 10 is shown.

In FIGS. 2A and 2B, for the fluorescent lamp driver 1 of the first embodiment, at least one drive/control circuit 5 (switching means and switching driving means) and two transformers, a transformer TR1*a* (first transformer) and a transformer TR1*b* (second transformer), are provided to drive the illustrated cold cathode fluorescent lamp 10.

Firstly, the dimming signal Ap from the dimmer unit 24 as previously shown in FIG. 1 is supplied to the drive/control circuit 5. A DC power supply voltage not shown in the figure is inputted to this drive/control circuit 5 to generate AC voltages. These AC voltages are supplied to respective primary winding N1 of the transformer TR1*a* and the transformer TR1*b* as illustrated. The internal constitution of the drive/control circuit 5 will be described later.

The AC voltage obtained in the primary winding N1 of the transformer TR1*a* is excited in a secondary winding N2 wound on the secondary side of this transformer TR1*a*. In this case, the winding directions of the primary winding N1 and the secondary winding N2 in the transformer TR1*a* are the same as illustrated, thereby obtaining the AC voltages having the same polarity in these primary winding N1 and the secondary winding N2.

The winding direction herein indicates a direction from a winding start to a winding end.

A winding start portion of the secondary winding N2 of the transformer TR1*a* is connected to the one terminal t10*a* of the cold cathode fluorescent lamp 10. A winding end portion of the secondary winding N2 is connected to a grounding wire via a current detection resistor R1 as illustrated. Accordingly, the AC voltage excited from the primary winding N1 to the secondary winding N2 in the transformer TR1*a* is applied to the terminal t10 *a* of the cold cathode fluorescent lamp 10.

From a connecting point between the winding end portion of the secondary winding N2 and the current detection resistor R1, a detection line Ln1 is inputted to the drive/control circuit 5 as illustrated, which will be described later.

Furthermore, in the fluorescent lamp driver 1 of the embodiment, the transformer TR1*b* is provided so as to correspond to the above-described transformer TR1*a*. In this case, the transformer TR1*a* and the transformer TR1*b* are constituted to have equivalent characteristics, respectively. Namely, for example, winding wires and cores to be used, the respective winding numbers of the primary winding N1 and the secondary winding N2, and a gap length formed in the cores are made equivalent or similar, thereby making the respective characteristics equivalent.

Furthermore, the transformer TR1*a* and the transformer TR1*b* are arranged to be located on both sides of the cold cathode fluorescent lamp 10 in a longitudinal direction as illustrated. Namely, the transformer TR1*a* is arranged on one terminal side (side of the terminal t10*a*) of the cold cathode fluorescent lamp 10 and the transformer TR1*b* is arranged on the other terminal side (side of the terminal t10*b*) of the cold cathode fluorescent lamp 10.

As illustrated, a winding end portion of the primary winding N1 on the transformer TR1*b* side is connected to a winding start portion of the primary winding N1 of the transformer TR1*a*. Also, a winding start portion of the primary winding N1 of the transformer TR1*b* is connected to the winding end portion of the primary winding N1 of the transformer TR1*a*. According to such a connection form, the transformer TR1*a* and the transformer TR1*b* in this case are connected in parallel.

Furthermore, according to the above-mentioned connection form, while the winding directions of the respective primary winding N1 of the transformers TR1*a* and TR1*b* are the same, the connecting directions are reverse to each other as seen from the drive/control circuit 5 as a voltage supply source, so that the AC voltages obtained in the respective primary winding N1 have reverse polarity to each other.

In the transformer TR1*b*, the winding directions of the primary winding N1 and the secondary winding N2 are the same as in the case of the transformer TR1*a*. Namely, an AC voltage having the same polarity as an AC voltage obtained in the primary winding N1 of the transformer TR1*b* is applied to the terminal t10*b* of the cold cathode fluorescent lamp 10. In addition, a winding end portion of this secondary winding N2 is grounded and a winding start portion thereof is connected to the other terminal t10*b* of the cold cathode fluorescent lamp 10. According to such a constitution, with respect to the terminal t10*b* of the cold cathode fluorescent lamp 10, an AC voltage which is excited from the primary winding N1 to the secondary winding N2 of the transformer TR1*b* and has polarity reverse to the AC voltage obtained in the primary winding N1 of the transformer TR1*a* is applied. Namely, the AC voltages each having reverse polarity are applied to the terminal t10*a* and the terminal t10*b* of the cold cathode fluorescent lamp 10 in this case.

Figure 3A:
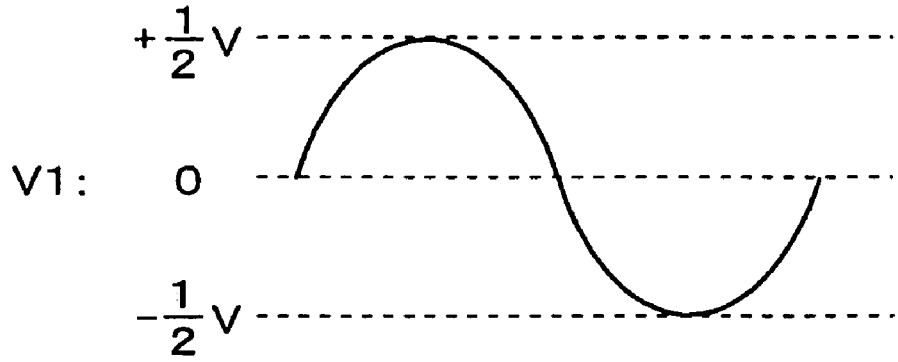
FIG. 3A and FIG. 3B are views exemplifying voltage waveforms applied to a fluorescent lamp in the fluorescent lamp driver of the embodiment.
Figure 3B:
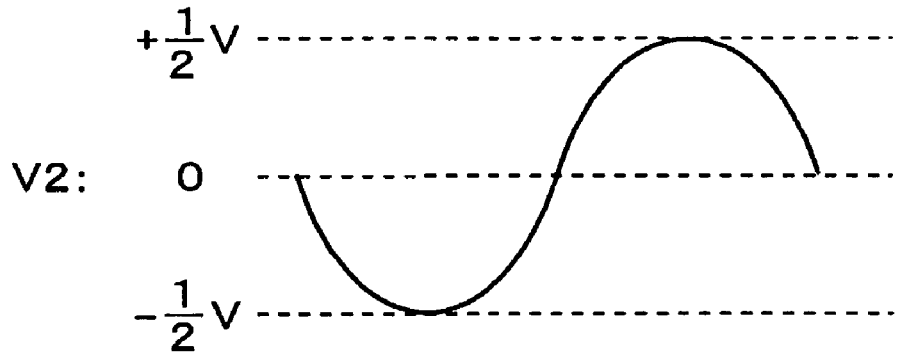
Figure 7:
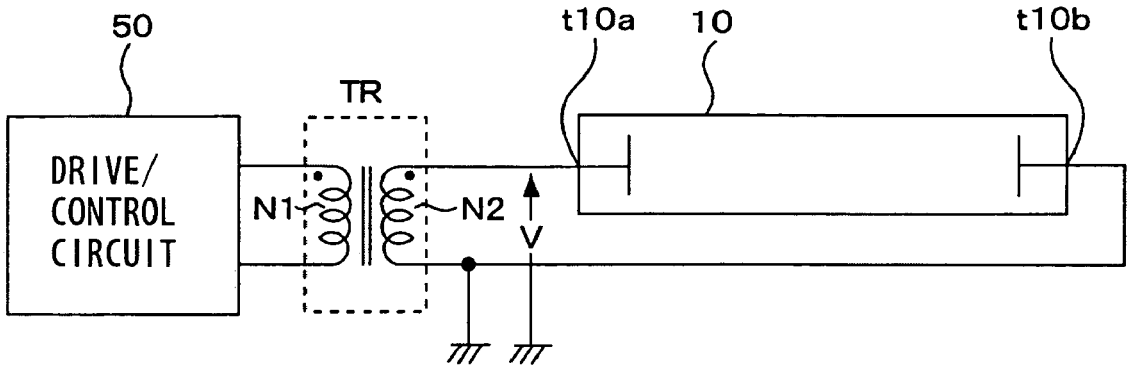
FIG. 7 is a view showing a structural example of a fluorescent lamp driver of a related art.
Figure 8:
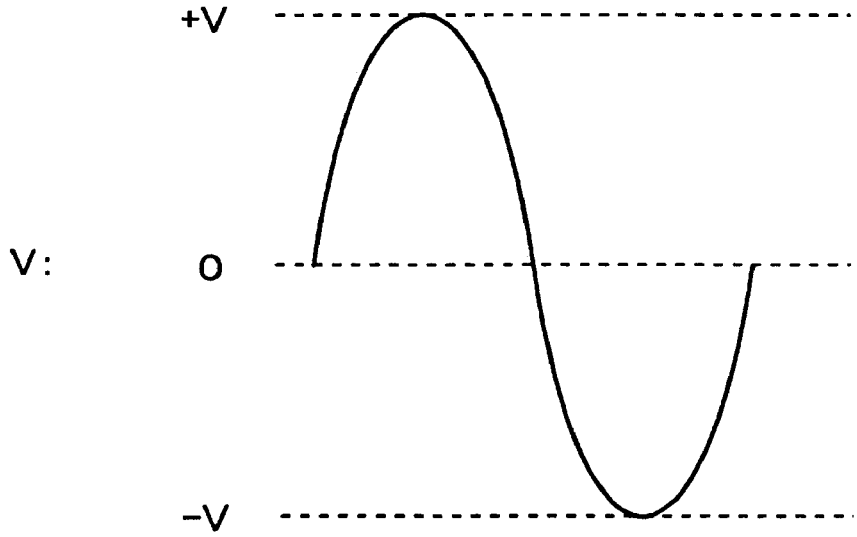
RELATED ART FIG. 8
FIG. 8 is a view exemplifying a voltage waveform applied to a fluorescent lamp in the fluorescent lamp driver of the related art.

In this manner, by applying the AC voltages each having reverse polarity to the terminal t10*a* and the terminal t10*b* of the cold cathode fluorescent lamp 10, a voltage V1 and a voltage V2 as shown in the next FIG. 3A and FIG. 3B are applied to the terminal t10*a* and the terminal t10*b* in this case, respectively. Specifically, in the related art constitution as shown in the FIG. 7, in a case where the voltage level to be applied to the terminal t10*a* is set to "V", the voltage V1 and the voltage V2 each of which is at the level of "½V", that is, one-half of the "V", as shown in FIGS. 3A and 3B, respectively are applied.

In this case, since the polarity of the AC voltages applied to the terminal t10*a* and the terminal t10*b* is mutually reversed as described above, for example, in a case where the voltage V1 of "+½V" is applied to the terminal t10*a*, the voltage V1 of "−½V" is applied to the terminal t10*b*. Namely, by applying the voltages each having the reverse polarity at the level of "½V", the voltage at "V" level can be consequently applied to the cold cathode fluorescent lamp 10. Accordingly, in this case, by applying, on both sides of the cold cathode fluorescent lamp 10, the AC voltages at one-half of the level of the related art constitution in the above-described FIG. 7, the driving voltage similar to the related art constitution can be consequently applied to the cold cathode fluorescent lamp 10.

Figure 4A:
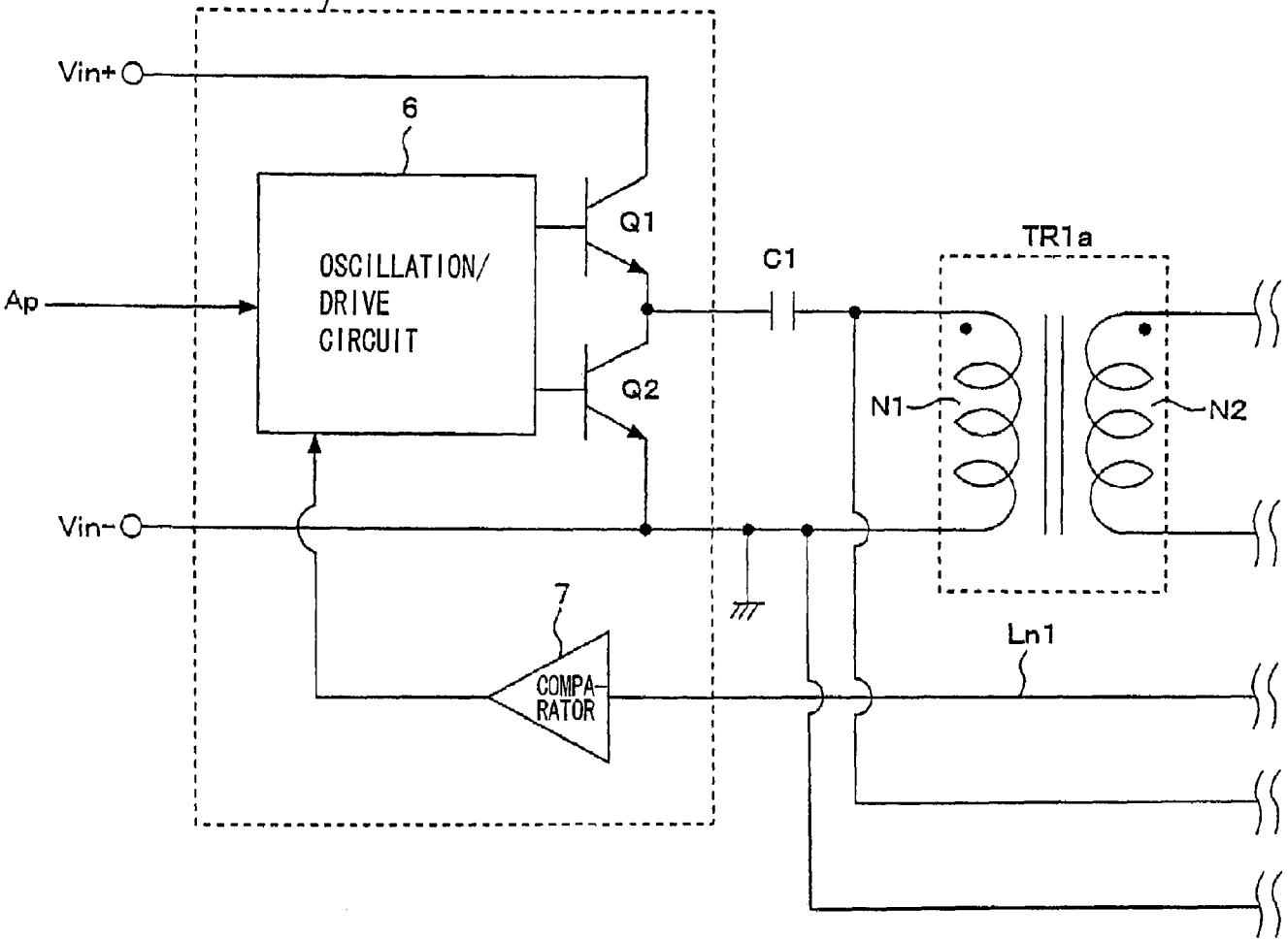
FIGS. 4A and 4B are views showing an internal structural example of a drive/control circuit provided in the fluorescent lamp driver of the embodiment.
Figure 4B:
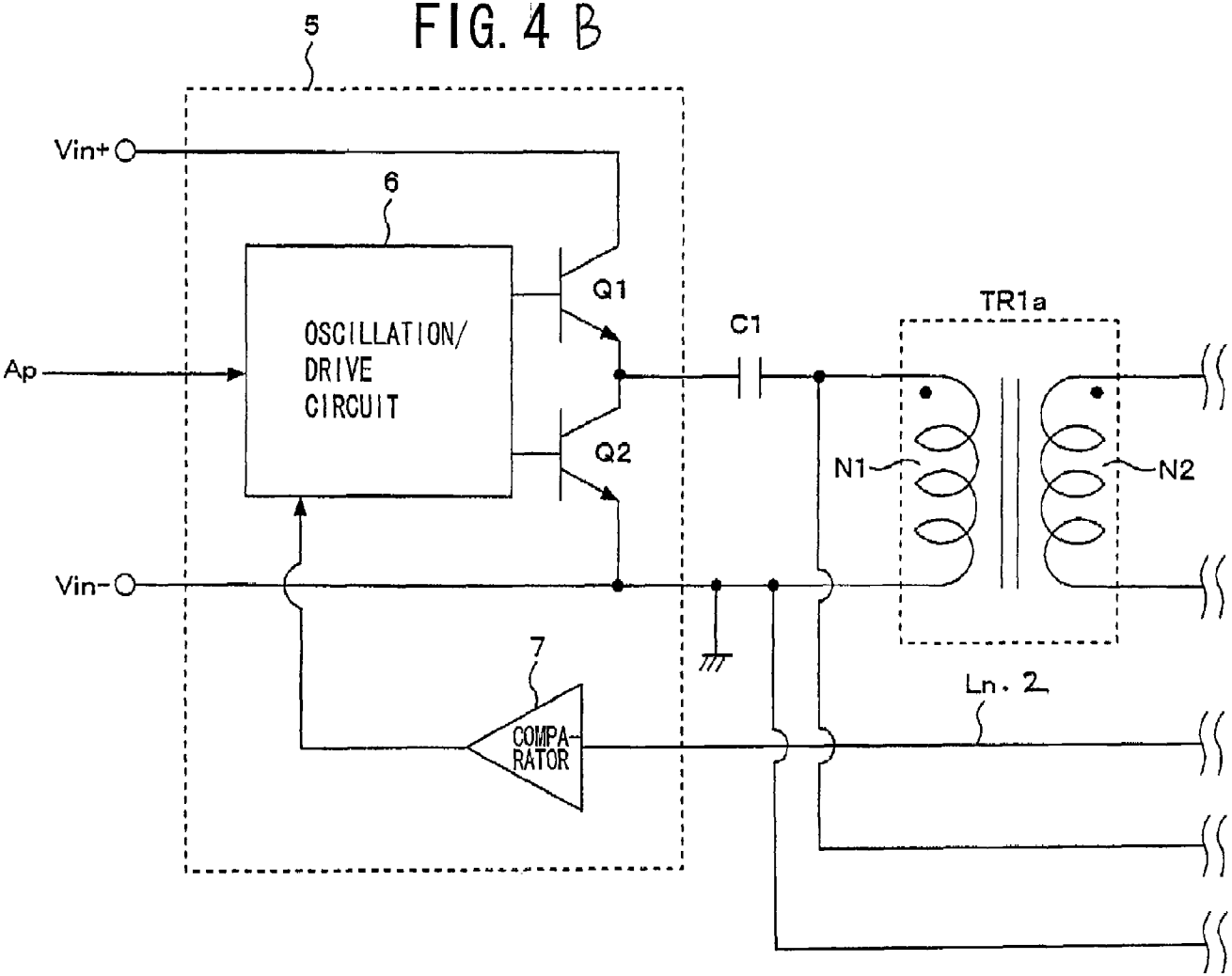

FIGS. 4A and 4B show an example of an internal structure of the drive/control circuit 5. In this diagram, the transformer TR1*a*, a resonant capacitor C1 and the detection line Ln1, which are shown in FIGS. 2A and 2B, are also shown.

Firstly, this drive/control circuit 5 comprises an oscillation/drive circuit 6, a switching element Q1 and a switching element Q2 which are NPN type transistors in this case, and a comparator 7, as illustrated.

As illustrated, a collector of the switching element Q1 is connected to the positive pole side of a DC power supply voltage Vin supplied to the drive/control circuit 5 and an emitter thereof is connected to a collector of the switching element Q2. Furthermore, an emitter of the switching element Q2 is connected to the negative pole side of the DC power supply voltage Vin.

To a connecting point (switching output point) between the emitter of the switching element Q1 and the collector of the switching element Q2, the winding start portion of the primary winding N1 of the transformer TR1*a* is connected via a serial connection of the resonant capacitor C1 as illustrated. Namely, as described in FIGS. 2A and 2B, since this winding start portion of the primary winding N1 is connected to the winding end portion of the primary winding N1 of the transformer TR1*b*, the above-mentioned switching output point is connected to a connecting point between the winding start portion of the primary winding N1 of the transformer TR1*a* and the winding end portion of the primary winding N1 of the transformer TR1*b* via the serial connection of the resonant capacitor C1.

Furthermore, the winding end portion of the primary winding N1 of the transformer TR1*a* is connected to the emitter of the switching element Q2. Namely, the emitter of the switching element Q2 is connected to a connecting point between the winding end portion of the primary winding N1 of the transformer TR1*a* and the winding start portion of the primary winding N1 of the transformer TR1*b*. Furthermore, a connecting point between the emitter of the switching element Q2 and the connecting point between the winding end portion of the primary winding N1 of the transformer TR1*a* and the winding start end portion of the primary winding N1 of the transformer TR1*b* is grounded as illustrated.

The oscillation/drive circuit 6 has an oscillator therein, and drives the above-mentioned switching element Q1 and switching element Q2 so as to turn on/off alternately in accordance with an oscillation signal of the oscillator. By turning on/off the switching element Q1 and the switching element Q2 alternately in this manner, alternating currents are caused to flow in the primary winding N1 of the transformer TR1*a* and the primary winding N1 of the transformer TR1*b*, which are connected to the switching output point between the switching element Q1 and the switching element Q2. By obtaining the alternating currents in the respective primary winding N1, the AC voltages are generated in the respective primary winding N1, and thereby obtaining the AC voltages also in the secondary winding N2 of the transformer TR1*a* and the transformer TR1*b* as described above.

Here, the oscillation/drive circuit 6 in this case controls switching frequencies of the switching element Q1 and the switching element Q2 in accordance with a control signal from the comparator 7, based on the input from the illustrated detection line Ln1.

In this case, as shown in FIGS. 2A and 2B, the current detection resistor R1 is inserted between the winding end portion of the secondary winding N2 of the transformer TR1*a* and the grounding wire, and a detected voltage at the level in accordance with a current flowing in the secondary winding N2 of the transformer TR1*a* is obtained in the detection line Ln1. The comparator 7 outputs the control signal at the level in accordance with this detected voltage supplied via the detection line Ln1 to the oscillation/drive circuit 6. The oscillation/drive circuit 6 controls the switching frequencies of the switching element Q1 and the switching element Q2 in accordance with such a control signal level from the comparator 7. This allows the current level flowing in the secondary winding N2 to be controlled so as to be constant at a set level. Namely, the light emission amount of the cold cathode fluorescent lamp 10 is controlled to be constant.

Furthermore, in this case, the dimming signal Ap from the dimmer unit 24, which is supplied to the drive/control circuit 5 as shown in FIGS. 2A and 2B, is inputted to the oscillation/drive circuit 6. The oscillation/drive circuit 6 also performs the switching frequency control over the switching elements Q1, Q2 in accordance with this dimming signal Ap. Namely, the current level flowing in the secondary winding N2 is also controlled in accordance with this dimming signal Ap, which allows the light amount in the backlight unit 23 to be controlled in accordance with this dimming signal Ap.

In this case, the oscillation/drive circuit 6 performs stabilizing control as described above on the basis of only the detected voltage by the current detection resistor R1 provided on the transformer TR1*a* side. However, as described above, since the transformer TR1*a* and the transformer Tr1*b* are constituted so as to have the equivalent characteristics in this case, the stabilizing control over the secondary winding current of the transformer TR1*a* also works on the secondary winding current of the transformer TR1*b* similarly (See FIG. 2B). In other words, by stabilizing the secondary winding current on the transformer TR1*a* side, the secondary winding current on the transformer TR1*b* side can be consequently stabilized similarly.

Here, as shown in FIGS. 4A and 4B, in the fluorescent lamp driver 1 of the first embodiment, the resonant capacitor C1 is connected in series with the primary winding N1 for the following reasons.

As can be understood from the above description with reference to FIGS. 2A and 2B, in the present embodiment, for the drive/control circuit 5, the transformer TR1*a* and the transformer TR1*b* arranged to be located on both sides of the cold cathode fluorescent lamp 10 are provided. Thereby, in supplying the AC voltages generated by the drive/control circuit 5, while the wiring to the primary winding N1 of the transformer TR1*a*, which is arranged on the drive/control circuit 5 side, can be relatively short, the wiring to the primary winding N1 of the other transformer TR1*b* needs to be laid longer than or equal to a length of the cold cathode fluorescent lamp 10 at least.

At this time, since the current flowing from the drive/control circuit 5 to each of the primary winding N1 has a relatively high frequency, if the wiring from the drive/control circuit 5 to the primary winding N1 is made long, there arise concerns about noise radiation in this line. By inserting the resonant capacitor C1 to be in series with the primary winding N1 of each of the transformers TR, a resonant circuit is formed by a capacitance of this resonant capacitor C1 and a leakage inductance of the primary winding N1, which can make the current flowing on the primary side of each of the transformers TR into a sinusoidal waveform. Namely, this can reduce higher harmonics generated in the high-frequency current flowing in the line connecting from the drive/control circuit 5 side to the primary winding N1 side of the transformer TR1*b*, and thus the noise radiation can be suppressed.

As described heretofore, according to the fluorescent lamp driver 1 of the present embodiment, by employing the constitution in which the AC voltages each having the reverse polarity are applied on both sides of the cold cathode fluorescent lamp 10, the voltage level to be applied to each of the terminals of the cold cathode fluorescent lamp 10 can be reduced to one-half of the level in the case of the related art constitution in which output by one transformer is applied to only one terminal of the cold cathode fluorescent lamp 10. In this manner, since the voltage level to be applied to the terminal of the cold cathode fluorescent lamp 10 can be decreased, the leak current can be reduced. The reduction in leak current in this manner can improve the luminous efficiency.

Furthermore, in this manner, by employing the constitution in which the AC voltages are applied from both sides of the cold cathode fluorescent lamp 10, there can be reduced luminance unevenness that only the voltage applied side becomes bright when a high voltage is applied to only one terminal in the related art and so on.

Furthermore, according to the fluorescent lamp driver 1 of the present embodiment, in order to realize the constitution in which the AC voltages are applied from both sides of the cold cathode fluorescent lamp 10 as described above, as the transformers receiving the supply of the AC voltages from the drive/control circuit 5 generating the alternating voltage for driving, the two transformers connected so as to obtain the AC voltages each having reverse polarity in the respective secondary winding are provided, which can make it unnecessary that drive circuits for generating the AC voltages each having reverse polarity are provided on both sides of the cold cathode fluorescent lamp 10. Namely, in this point, when realizing the constitution in which the AC voltages are applied from both sides of the cold cathode fluorescent lamp 10, increases in circuit area and circuit manufacturing costs can be suppressed.

Furthermore, by employing the constitution in which the transformer TR1*a* and the transformer TR1*b* are provided to apply the AC voltages from both sides of the cold cathode fluorescent lamp 10 as described above, a core size of the transformer TR1*a* and the transformer TR1*b* in this case can be made smaller as compared with the related art constitution in which only one transformer is provided to apply a high voltage on only one side of the cold cathode fluorescent lamp 10. This allows cores of the transformers TR to be thinner than the one in the related art, thereby achieving the thinner backlight unit 23 and further the thinner liquid crystal display apparatus 20 than the one in the related art.

Here, in the present embodiment, the reason why the transformer TR1*a* and the transformer TR1*b* are arranged to be located on both sides of the cold cathode fluorescent lamp 10 as described above is as follows.

For example, if the transformer TR1*b* is arranged on the same side as the transformer TR1*a*, the wiring from the secondary winding N2 of the transformer TR1*b* to the other terminal of the cold cathode fluorescent lamp 10 needs to be laid longer than or equal to at least the length of the cold cathode fluorescent lamp 10. Such longer wiring from the secondary winding N2 to the terminal of the cold cathode fluorescent lamp 10 may also increase the leak current level. Namely, when the wiring from the secondary winding N2 to the terminal of the cold cathode fluorescent lamp 10 is made long, the effect of suppressing the leak current by the reduction in the applied voltage level will also be reduced. In particular, in the constitution in which a relatively high-voltage, high-frequency driving voltage is applied as in the cold cathode fluorescent lamp, such an increase in the leak current level due to the increased wiring length from the secondary winding N2 to the terminal of the cold cathode fluorescent lamp becomes serious.

In the present embodiment, by arranging the transformer TR1*a* and the transformer TR1*b* on the respective terminal sides of the cold cathode fluorescent lamp 10, the wiring lengths from the secondary winding N2 to the terminals are minimized on both sides of the cold cathode fluorescent lamp 10. As a result of the arrangement, the leak current level can be minimized. Accordingly, in the present embodiment, the luminous efficiency is improved by arranging the transformer TR1*a* and the transformer TR1*b* to be located on both ends of the cold cathode fluorescent lamp 10.

Furthermore, according to the liquid crystal display apparatus 20 of the embodiment comprising the fluorescent lamp driver 1 as the present embodiment as described above, in the backlight unit 23, the luminous efficiency can be improved and the luminance unevenness can be reduced, and further a thinner liquid crystal display apparatus can be realized.

Figure 5A:
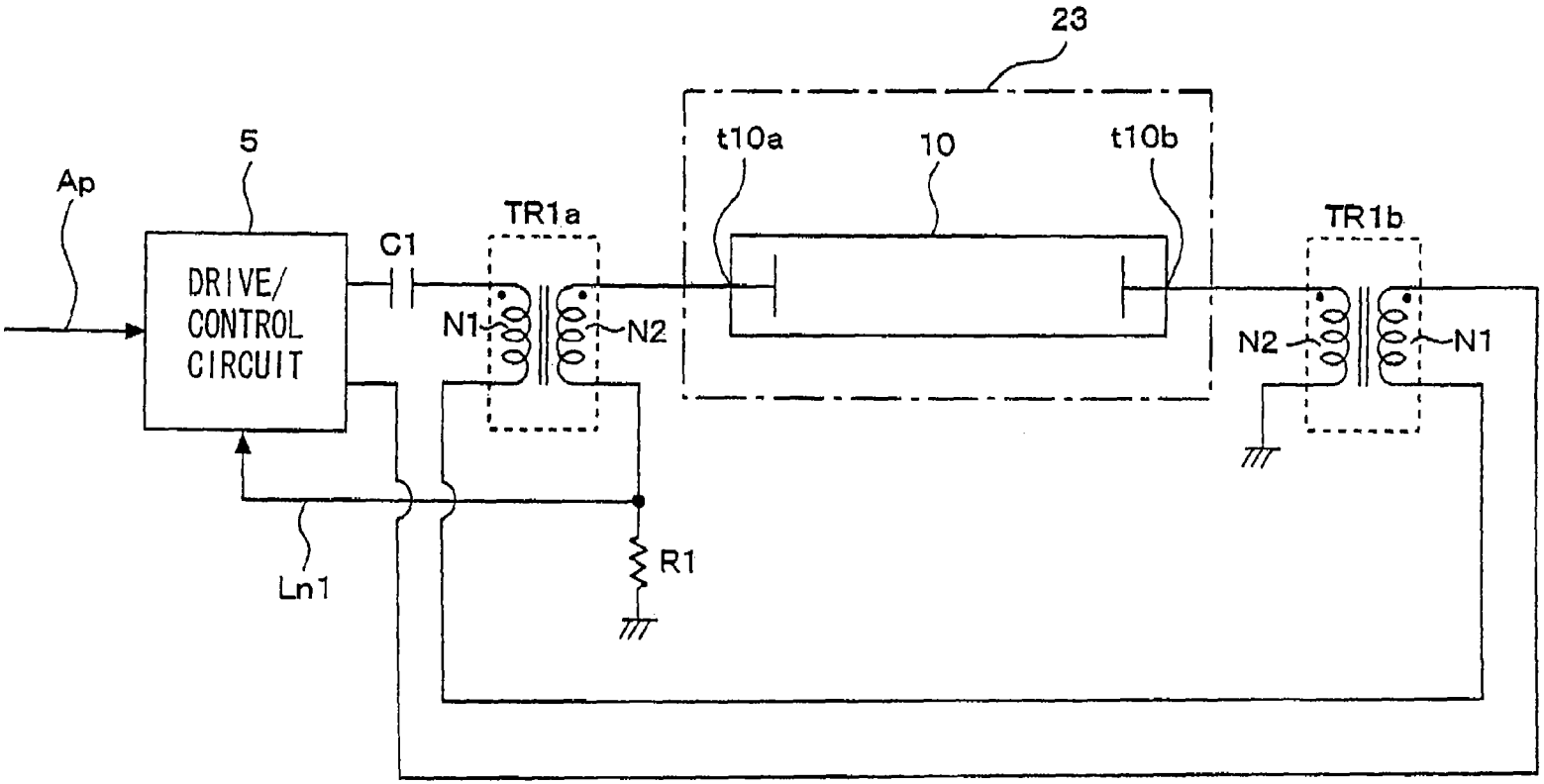
FIGS. 5A and 5B are views showing a structural example of a fluorescent lamp driver in a second embodiment of the present invention.
Figure 5B:
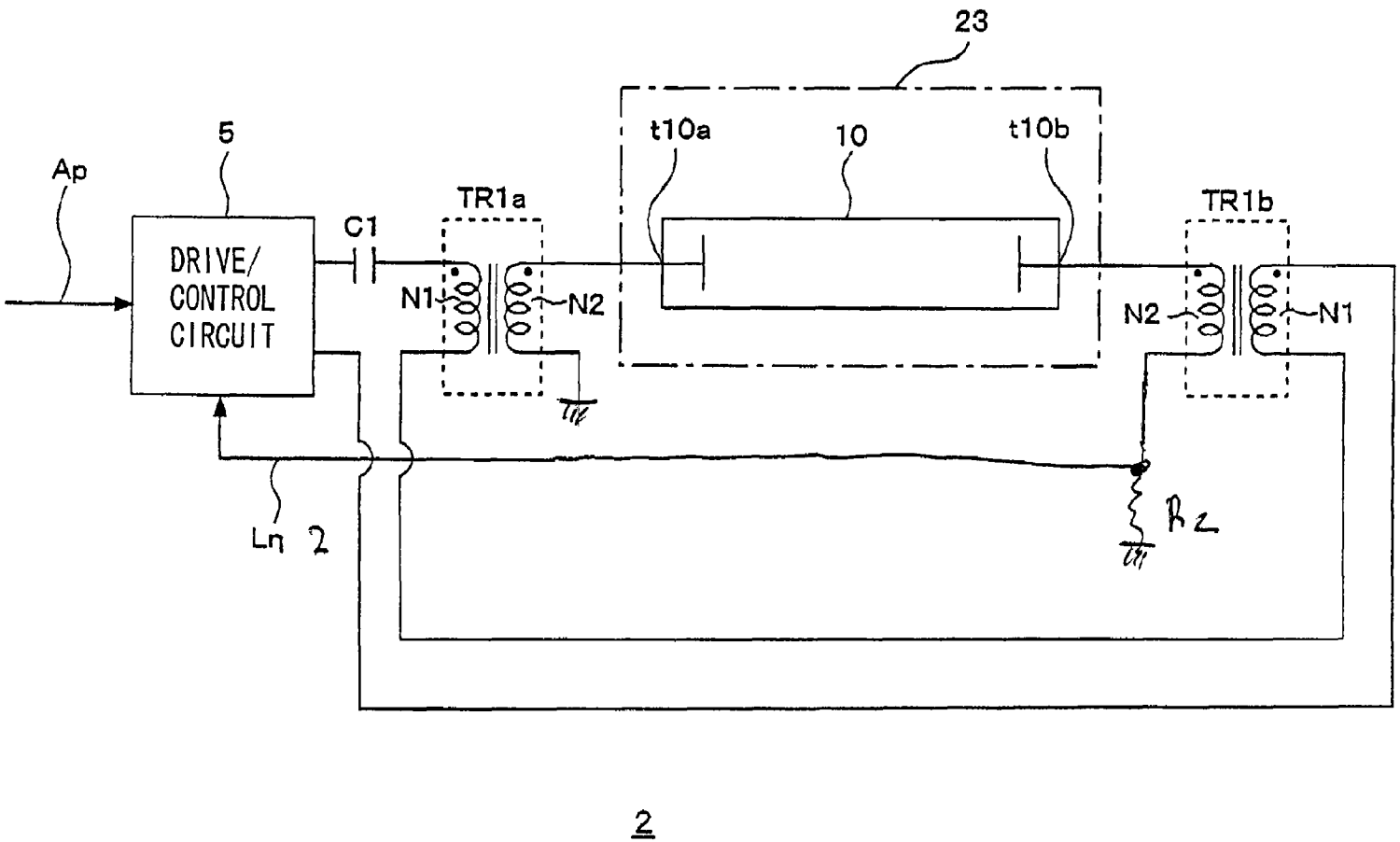

Subsequently, a constitutional example of a fluorescent lamp driver 2 according to a second embodiment of the present invention is illustrated in FIGS. 5A and 5B. In FIGS. 5A and 5B, the same reference numerals are given to the similar parts to those described in FIGS. 2A and 2B. Also, a drive/control circuit 5 as shown in this figure has a similar constitution to the one described in FIGS. 4A and 4B. In this embodiment, a case where only one cold cathode fluorescent lamp 10 is used in a backlight unit 23 is also exemplified.

Referring to FIGS. 5A and 5B, in the fluorescent lamp driver 2 of the second embodiment, a transformer TR1*a* and a transformer TR1*b*, which are connected in parallel in the case of the first embodiment, are connected in series. In this case, a winding start portion of primary winding N1 of the transformer TR1*a* is, similar to the case in FIGS. 4A and 4B, connected to a connecting point (switching output point) between an emitter of a switching element Q1 and a collector of a switching Q2 inside the drive/control circuit 5 via the series connection of a resonant capacitor C1.

Different from the case in FIGS. 4A and 4B, a winding end portion of the primary winding N1 of the transformer TR1*a* is not connected directly to an emitter of the switching element Q2 inside the drive/control circuit 5. Namely, a winding end portion of primary winding N1 of the transformer TR1*b* is connected to the winding end portion of the primary winding N1 of the transformer TR1*a*, and a winding start portion of the primary winding N1 of the transformer Tr1*b* is connected to the emitter of the switching element Q2 inside the drive/control circuit 5.

According to such a connection form, the transformer TR1*a* and the transformer TR*b* in this case are in a serial connection by connecting the respective primary winding N1 in series between the switching output point and the emitter of the switching element Q2 inside the drive/control circuit 5. As described above, the respective primary winding N1 is inserted in series between the switching output point and the emitter of the switching element Q2 as a serial-connected circuit in which the winding end portions of the respective primary winding N1 are connected to each other. Also, in this case, this allows the respective primary winding N1 to be connected in a reverse direction to each other with respect to the drive/control circuit 5 serving as a voltage supply source, so that AC voltages each having reverse polarity can be obtained.

In addition, in this case, since the winding direction of the primary winding N1 and the secondary winding N2 in the transformer TR1*a* and the transformer TR1*b* is also the same, AC voltages each having reverse polarity which are obtained in the secondary winding N2 of the transformer TR1*a* and the secondary winding N2 of the transformer TR1*b* are applied to the terminal t10*a* and the terminal t10*b* of the cold cathode fluorescent lamp 10, respectively.

In this manner, according to the constitution of the fluorescent lamp driver 2 of the second embodiment, similar to the fluorescent lamp driver 1 of the first embodiment, the AC voltages each having reverse polarity can be applied to the respective terminals of the cold cathode fluorescent lamp 10 on the basis of the output of the one drive/control circuit 5. Namely, in this case also, effects similar to the case of the first embodiment can be attained.

Figure 6:
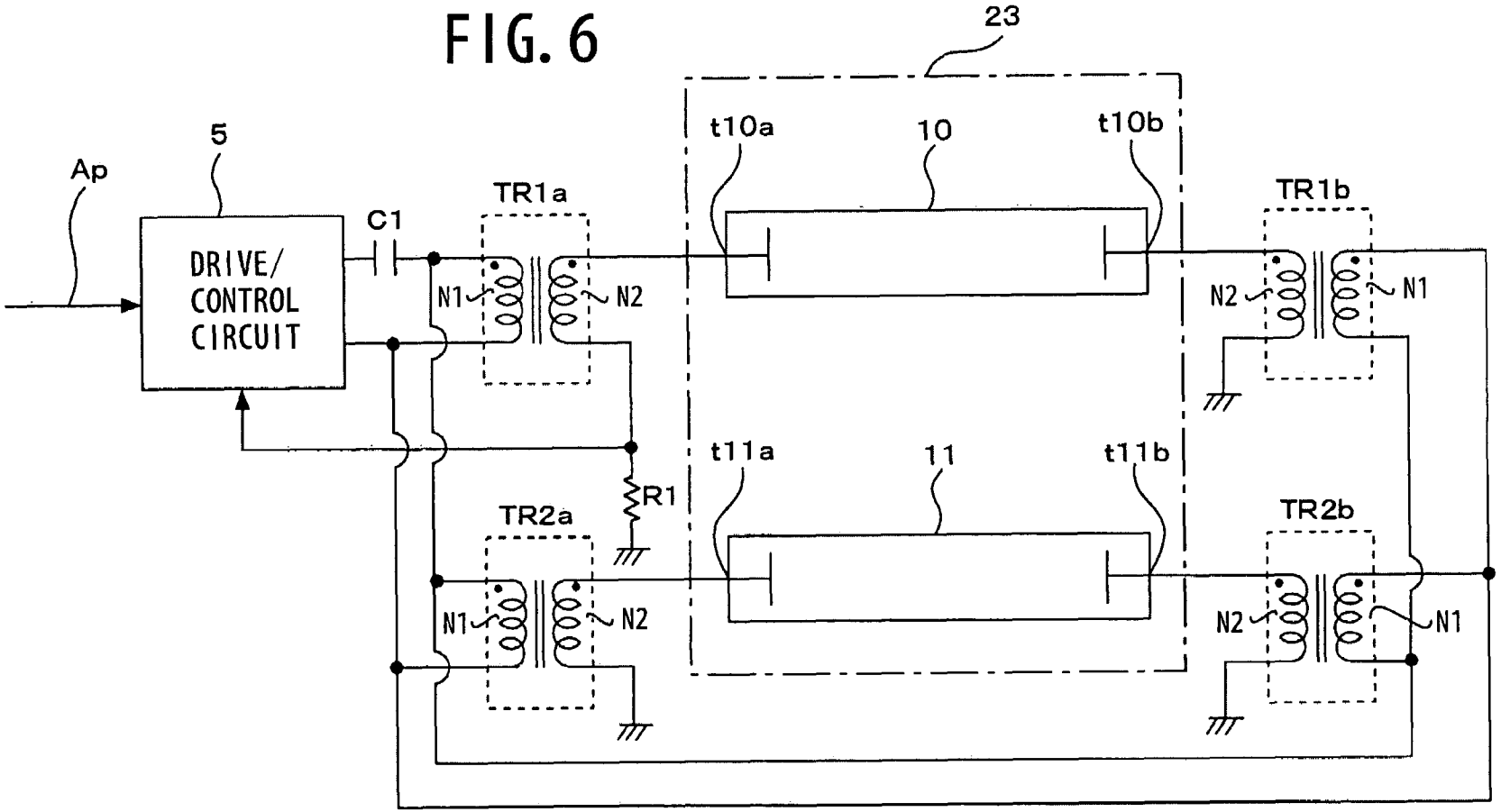
FIG. 6 is a view showing a structural example of a fluorescent lamp driver in a third embodiment of the present invention.

Furthermore, FIG. 6 shows a constitutional example of a fluorescent lamp driver 3 as a third embodiment in the present invention. In this figure, the same reference numerals are also given to the parts functioning similarly to those previously described in FIGS. 2A and 2B and a description thereof is omitted. Furthermore, in this case, the constitution of a drive/control circuit 5 is also similar to the one shown in FIGS. 4A and 4B. The fluorescent lamp driver 3 of the third embodiment is constituted such that the one drive/control circuit 5 drives a plurality of cold cathode fluorescent lamps. In this case, an example having two fluorescent lamps, the cold cathode fluorescent lamp 10 and a cold cathode fluorescent lamp 11, is illustrated.

Firstly, in the cold cathode lamp driver 3, a transformer TR2*a* and a transformer TR2*b* are added to the constitution shown in FIGS. 2A and 2B. These transformer TR2*a* and transformer TR2*b* are constituted so as to obtain characteristics equivalent to those of a transformer TR1*a* and a transformer TR1*b*, and the winding directions of primary winding N1 and secondary winding N2 thereof are the same. Furthermore, the transformer TR2*a* and the transformer TR2*b* are arranged to be located on both ends of the cold cathode fluorescent lamp 11.

In this case, as the primary winding N1 of the transformer TR2*a*, a winding start portion thereof is connected to the line from a winding start portion of primary winding N1 of the transformer TR1*a* to a winding end portion of primary winding N1 of the transformer TR1*b* side. Furthermore, a winding end portion of the primary winding N1 of this transformer TR2*a* is connected to the line from a winding end portion of the primary winding N1 of the transformer TR1*a* to a winding start portion of the primary winding N1 of the transformer TR1*b*. Namely, according to this arrangement, the relationship between the transformer TR1*a* and the transformer TR2*a* is in parallel, and the respective primary winding N1 is connected in the same direction with respect to the voltage supply source, thereby obtaining AC voltages having the same polarity.

Furthermore, as for primary winding N1 of the transformer TR2*b*, a winding start portion thereof is connected to the line from the winding end portion of the primary winding N1 of the transformer TR1*a* to the winding start portion of the primary winding N1 of the transformer TR1*b*. In addition, a winding end portion of the primary winding N1 of this transformer TR2*b* is connected to the line from the winding start portion of the primary winding N1 of the transformer TR1*a* to the winding end portion of the primary winding N1 of the transformer TR1*b*. Accordingly, while the transformer TR1*a* and the transformer TR2*b* also have the parallel relationship, the respective primary winding N1 is reverse in connecting direction, thereby obtaining AC voltages each having reverse polarity.

In addition, a winding start portion of the secondary winding N2 of the transformer TR2*a* is connected to a terminal t11*a* of the cold cathode fluorescent lamp 11, and a winding end portion thereof is connected to a grounding wire. Furthermore, a winding start portion of the secondary winding N2 of the transformer TR2*b* is connected to a terminal t10*b* of the cold cathode fluorescent lamp 11 and a winding end portion thereof is similarly connected to a grounding wire.

In the above-described manner, the respective primary winding N1 of the transformer TR1*a* and the transformer TR2*a* is the same in the connecting direction (with respect to the voltage supply source), thereby obtaining the AC voltages having the same polarity. In contrast, the respective primary winding N1 of the transformer TR1*a* and the transformer TR2*b* is reverse in connecting direction, thereby obtaining AC voltages each having reverse polarity. Accordingly, in the transformer TR2*a* and the transformer TR2*b*, the AC voltages each having reverse polarity can be obtained with respect to the respective winding N2. Namely, this allows the AC voltages each having reverse polarity to be applied to the terminal t11*a* and the terminal t11*b* of the cold cathode fluorescent lamp 11, respectively.

Here, the case based on the constitution in which the transformer TR1*a* and the transformer TR1*b* arranged at both ends of the cold cathode fluorescent lamp 10 are connected in parallel is taken as an example of the constitution in which the plurality of cold cathode fluorescent lamps are driven by the one drive/control circuit 5. However, a case based on the constitution in which the transformer TR1*a* and the transformer TR1*b* are in serial connection as shown in FIGS. 5A and 5B can also employ the similar constitution. Namely, in this case, the winding start portion of the primary winding N1 of the transformer TR2*a* is connected to the line from the winding end portion of the primary winding N1 of the transformer TR1*a* to the winding end portion of the primary winding N1 of the transformer TR1*b* as shown in FIGS. 5A and 5B. Furthermore, the winding end portion of the primary winding N1 of this transformer TR2*a* is connected to the line from the winding start portion of the primary winding N1 of the transformer TR1*b* to an emitter of a switching element Q2. Still further, the winding start portion of the primary winding N1 of the transformer TR2*b* is connected to the line from the winding start portion of the primary winding N1 of the transformer TR1*b* to the emitter of the switching element Q2, and the winding end portion of the primary winding N1 of the transformer TR2*b* is connected to the line from the winding end portion of the primary winding N1 of the transformer TR1*a* to the winding end portion of the primary winding N1 of the transformer TR1*b*.

Furthermore, while here, the constitution corresponding to the two cold cathode fluorescent lamps is exemplified, a constitution corresponding to three fluorescent lamps or more can be employed by connecting respective start and end portions of primary winding N1 of an additional transformer(s) TR to the lines connecting the respective start and end portions of the primary winding N1 of the transformer TR1*a* and the transformer TR1*b* in the same manner as described above.

Still further, in a case based on the constitution in FIGS. 5A and 5B, the respective start and end portions of the primary winding N1 of the additional transformer(s) TR may be similarly connected to the line connecting the respective winding end portions of the primary winding N1 of the transformer TR1*a* and the transformer TR1*b* and the line connecting the winding start portion of the primary winding N1 of the transformer TR1*b* and the emitter of the switching element Q2, respectively.

Also, in this case, the drive/control circuit 5 stabilizes a secondary winding current based on detection output by the current detection resistor R1 provided for the secondary winding N2 of the transformer TR1*a*. However, since the respective transformers TR have equivalent characteristics as described above, the stabilization control over the secondary winding current of each of the transformers TR can be performed similarly.

Here, in the above-described embodiments, after the primary winding N1 and the secondary winding N2 of the respective transformers TR are wound in the same direction, the respective primary winding N1 is connected to each other in such a manner that the connecting directions thereof are reverse with respect to the voltage supply source to obtain the AC voltages each having reverse polarity in the respective primary winding N1, thereby obtaining the AC voltages each having reverse polarity in the respective secondary winding N2. However, in place of this constitution, a constitution can be employed in which the respective primary winding N1 is connected in the same connecting direction to obtain the alternating voltages having the same polarity and then the primary winding N1 and the secondary winding N2 of either of the transformers TR are wound in a different direction, resulting in the AC voltages each having reverse polarity in the respective secondary winding N2.

As one example, while in the case of the constitution shown in FIGS. 2A and 2B, the winding end portions of the respective primary winding N1 of the transformer TR1*a* and the transformer TR1*b* are connected to each other to obtain the AC voltages each having reverse polarity, the winding end portion of the primary winding N1 of the one transformer is connected to the winding start portion of the primary winding N1 of the other transformer to obtain the AC voltages having the same polarity and then, for example, in the transformer TR1*b*, the winding directions of the primary winding N1 and the secondary winding N2 are reversed. Accordingly, the AC voltage obtained in the secondary winding N2 on the transformer TR1*b* side has reverse polarity to the AC voltage obtained in the secondary winding N2 of the transformer TR1*a* side, so that the voltages each having reverse polarity are applied to the terminals t10*a* and t10*b* of the cold cathode fluorescent lamps 10, respectively.

Alternatively, the primary winding N1 on the transformer TR1*a* side and on the transformer TR1*b* side is caused to have the same polarity similarly, and then the winding directions of the primary winding N1 and the secondary winding N2 may be reversed on the transformer TR1*a* side.

In any one of the above-mentioned cases, the fluorescent lamp drivers of the embodiments only need to be constituted such that the AC voltages each having reverse polarity are consequently applied from both sides of the cold cathode fluorescent lamp by setting of the connecting directions of the primary winding N1 with respect to the voltage supply source (drive/control circuit 5) in the respective transformers TR or by setting of the winding directions of the primary winding N1 and the secondary winding N2 in each of the transformers TR.

Furthermore, while in the above-mentioned embodiments, as the constitution of the drive/control circuit 5, the cases in which the switching elements are driven in a separately excited manner are exemplified, a constitution of driving in a self-excited manner may be employed. Furthermore, as the switching elements, MOS-FET may be used instead of the transistors.

Furthermore, while in the above-mentioned embodiments, the cases where the fluorescent lamp driver drives the cold cathode fluorescent lamp are exemplified, a constitution of driving a hot cathode fluorescent lamp can be applied in the present invention. In addition, the fluorescent lamp driver of the present invention can also be preferably applied to other than the liquid crystal display apparatus.

It should be understood by those skilled in the art that various modifications, combinations, sub-combinations and alterations may occur depending on design requirements and other factors insofar as they are within the scope of the appended claims or the equivalents thereof.

What is claimed is:

1. A fluorescent lamp driver, comprising:

switching means having two switching elements connected in series, said switching means switches a DC power supply voltage, a first transformer and a second transformer configured to obtain AC voltages each having reverse polarity, as AC voltages excited from primary winding to secondary winding of the respective transformers, on the basis of output voltages of said switching means, switching driving means that drives said switching means in accordance with a required driving frequency, and detecting means that detect a current level flowing through the secondary wiring of said first transformer or said second transformer, wherein a first end of the primary winding of said first transformer and second end of the primary winding of said second transformer are connected to a connection point between said two switching elements and a second end of the primary winding of said first transformer and a first end of the primary winding of said second transformer are connected to an end of one of said two switching elements, wherein:

said first transformer and said second transformer are arranged to be located in the vicinity of both ends of said fluorescent lamp, and the AC voltage obtained in the secondary winding of said first transformer is applied to one terminal of said fluorescent lamp and the AC voltage obtained in the secondary winding of said second transformer is applied to the other terminal of said fluorescent lamp, said switching driving means is configured to control said driving frequency in accordance with the current level detected by said detecting means so as to stabilize the current level flowing through said secondary wiring.

2. The fluorescent lamp driver as claimed in claim 1, wherein:

the primary wiring of said first transformer and the primary wiring of said second transformer are connected to said connecting point so that the AC voltages obtained in the respective wirings have reverse polarity, and wiring directions of the primary wiring and the secondary wiring of said first transformer and wiring directions of the primary wiring and the secondary wiring of said second transformer are arranged to be the same, respectively.

3. The fluorescent lamp driver as claimed in claim 1, wherein:

the primary wiring of said first transformer and the primary wiring of said second transformer are connected to said connecting point so that the AC voltages obtained in the respective wirings have the same polarity, and wiring directions of the primary wiring and the secondary wiring are arranged to be reversed in either one of said first transformer and said second transformer.

4. The fluorescent lamp driver as claimed in claim 1, wherein:

a resonant capacitor is connected in series to both the primary wiring of said first transformer and the primary wiring of said second transformer.

5. The fluorescent lamp driver as claimed in claim 1, wherein:

said fluorescent lamp is provided in plural, and a plurality of sets of said first transformer and said second transformer corresponding to the number of said fluorescent lamps are connected to said switching means.

6. A liquid crystal display apparatus having at least a liquid crystal panel and a backlight unit composed of a fluorescent lamp, having:

a fluorescent lamp driving unit for driving said fluorescent lamp to emit light comprising:

switching means having two switching elements connected in series, said switching means switches a DC power supply voltage, a first transformer and a second transformer configured to obtain AC voltages each having reverse polarity, as AC voltages excited from primary winding to secondary winding of the respective transformers, on the basis of output voltages of said switching means, switching driving means that drives said switching means in accordance with a required driving frequency, and detecting means that detect a current level flowing through the secondary wiring of said first transformer or said second transformer, wherein a first end of the primary winding of said first transformer and second end of the primary winding of said second transformer are connected to a connection point between said two switching elements and a second end of the primary winding of said first transformer and a first end of the primary winding of said second transformer are connected to an end of one of said two switching elements, and wherein:

said first transformer and said second transformer are arranged to be located in the vicinity of both ends of said fluorescent lamp, and the AC voltage obtained in the secondary winding of said first transformer is applied to one terminal of said fluorescent lamp and the AC voltage obtained in the secondary winding of said second transformer is applied to the other terminal of said fluorescent lamp, said switching driving means is configured to control said driving frequency in accordance with the current level detected by said detecting means so as to stabilize the current level flowing through said secondary wiring.

* * * * *